US006602092B2

(12) United States Patent
Soubh

(10) Patent No.: US 6,602,092 B2
(45) Date of Patent: Aug. 5, 2003

(54) CABLE ASSEMBLY MODULE WITH COMPRESSIVE CONNECTOR

(75) Inventor: Emad Soubh, Camas, WA (US)

(73) Assignee: Ludlow Company LP, Chicapee, MA (US)

( * ) Notice: Subject to any disclaimer, the term of this patent is extended or adjusted under 35 U.S.C. 154(b) by 0 days.

(21) Appl. No.: 09/933,406

(22) Filed: Aug. 20, 2001

(65) Prior Publication Data

US 2003/0036304 A1 Feb. 20, 2003

(51) Int. Cl.[7] ..... H01R 13/04

(52) U.S. Cl. ..... 439/493; 439/494; 439/497; 439/581

(58) Field of Search ..... 439/492–499, 439/581, 610, 63

(56) References Cited

U.S. PATENT DOCUMENTS 3,689,865 A * 9/1972 Pierini et al. ..... 439/610
3,745,509 A * 7/1973 Woodward et al. ..... 439/492
4,130,334 A * 12/1978 Anderson ..... 439/492
4,406,512 A * 9/1983 Schell ..... 439/581
4,619,487 A * 10/1986 Brush, Jr. ..... 439/610
4,834,674 A * 5/1989 Beamenderfer et al. .... 439/494
4,887,976 A * 12/1989 Bennett et al. ..... 439/492
5,085,595 A * 2/1992 Koegel et al. ..... 439/494
5,385,478 A * 1/1995 Niekawa ..... 439/495
5,532,429 A * 7/1996 Dickerson et al. ..... 439/497
5,727,971 A * 3/1998 Junkins et al. ..... 439/610

* cited by examiner

*Primary Examiner*—Hien Vu
(74) *Attorney, Agent, or Firm*—Langlotz Patent Works, Inc.; Bennet K. Langlotz

(57) ABSTRACT

A cable includes a number of coaxial wires. Each of the wires has a central conductor encompassed by a dielectric sheath, and the sheath is encompassed by a conductive shield. The wires are arranged side-by-side in a row at an end of each wire, where a termination element is connected. The termination element has opposed major faces, with an array of first contacts on a first face, and an array of second contacts on the opposed face, each of the first contact being electrically connected to a corresponding second contact. Each of the central conductors of the wire elements is connected to a corresponding one of the first contacts. An electronic device may include circuit boards at each end, with contacts arranged for compressive contact with the second contacts. The termination element may be captured between a clamp and the board, with an elastomeric spring maintaining compression, and pinned holes in the termination element and board ensuring registration of the contacts.

23 Claims, 3 Drawing Sheets

CABLE ASSEMBLY MODULE WITH COMPRESSIVE CONNECTOR

FIELD OF THE INVENTION

This invention relates to multiple wire cables, and more particularly to small gauge coaxial wiring.

BACKGROUND AND SUMMARY OF THE INVENTION

High speed data and signal transmission rates are limited by the characteristics of the conductors used for transmission. For electronic systems having separate components connected by a flexible multi-wire cable, the signal rate is limited not only by the nature of the flexible wires used for the cable, but by the means of connection between the cable and each component.

For high-rate applications, various high speed cabling may employed, including high performance coaxial wiring, twisted pair wires, or other configurations. Any selected cable has a given bandwidth or frequency capability, and may use Low Voltage Differential Signals (LVDS) to limit switching noise that may generate electromagnetic interference with other electronic functions. While cable bandwidth is a theoretical maximum, in practical application, bandwidth tends to be severely limited by the connections between cable and the circuit boards or other components normally used in the system components limit usable bandwidth. Discontinuities at junctions between different types of conductors can lead to reflections and ringing that require an extended time for clock cycles. Moreover, differences in transmission times for different lines may generate a skew, which also requires an extended period to encompass the range of times at which signals sent on each line arrive at their destination.

Normally, a connection between a cable and components requires a connector element at each end of the cable. Connectors have the facility to connect to the cable, as well as to a component such as a circuit board. Where the system requires detachability of cables and components, each end of the cable may include two mating connector components, one connected to the cable end, and the other connected to the circuit board. Such connectors each generate several discontinuities that limit bandwidth below the theoretical capabilities of the cable. Such discontinuities occur where a circuit board connects to one connector portion, where that connector portion mates with the corresponding other connector portion, and where that connects with the cable wires. The accumulated effect of these discontinuities is believed to reduce frequency bandwidth by about one half in some cases.

In addition to their effect on performance, conventional connectors add significantly to the cost and bulk of high speed cable systems. The connectors must be installed on the component boards, as well as on the cable, requiring skilled labor costs. Cable wire and circuitry components may be provided by different suppliers, each with a part of a necessarily mating connector, making compatibility a concern. In addition, a cable manufacturer may have customers specifying different connectors, requiring the stocking of different components. Manufacturing costs are also significant in that cables with a multitude of conductors must be carefully assembled to ensure that each conductor is connected to the proper contact on each connector.

The present invention overcomes the limitations of the prior art by providing a cable with a number of coaxial wires. Each of the wires has a central conductor encompassed by a dielectric sheath, and the sheath is encompassed by a conductive shield. The wires are arranged side-by-side in a row at an end of each wire, where a termination element is connected. The termination element has opposed major faces, with an array of first contacts on a first face, and an array of second contacts on the opposed face, each of the first contact being electrically connected to a corresponding second contact. Each of the central conductors of the wire elements is connected to a corresponding one of the first contacts. An electronic device may include circuit boards at each end, with contacts arranged for compressive contact with the second contacts. The termination element may be captured between a clamp and the board, with an elastomeric spring maintaining compression, and pinned holes in the termination element and board ensuring registration of the contacts.

DETAILED DESCRIPTION OF A PREFERRED EMBODIMENT

Figure 1:
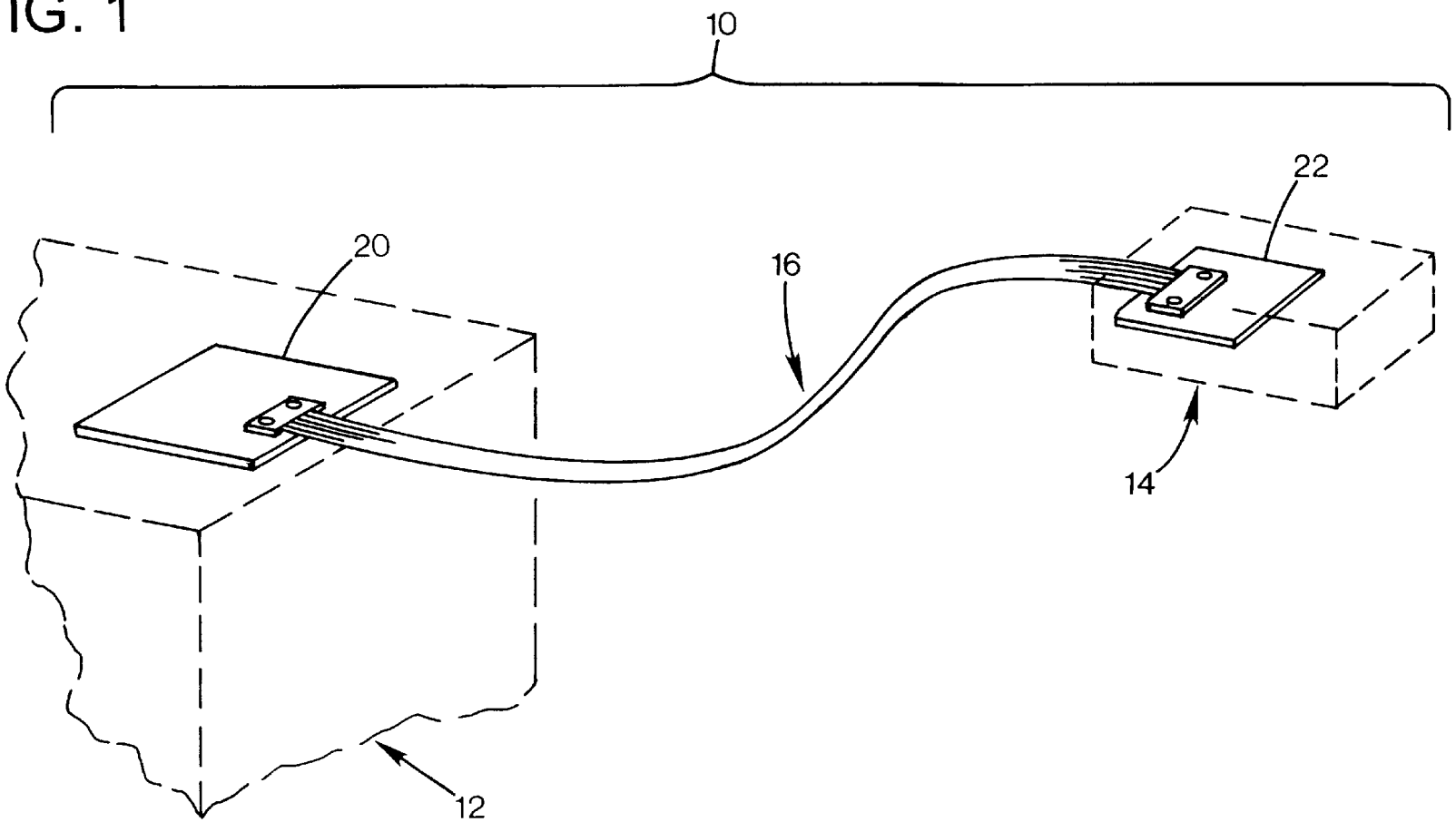
FIG. 1 is a perspective view of a cable assembly in a system of electronic components according to a preferred embodiment of the invention.

FIG. 1 shows an electronic system 10 having a first electronic device 12, a second electronic device 14, and a cable assembly 16. The devices may be of any type. The first and second devices respectively may be a base computer and a peripheral device, or a medical ultrasound imaging machine and transducer, for example. The devices may have separate housings connected by a flexible cable, as shown, or may be separate electronic components within a common housing, connected by the cable. Each device includes a circuit element 20, 22, which in the preferred embodiment is a rigid planar printed circuit board, but which in alternative embodiments may include flexible circuits, integrated circuit chips, ceramic circuits, hybrid circuit elements, or any circuit having exposed conductive contacts as will be discussed below.

Figure 2:
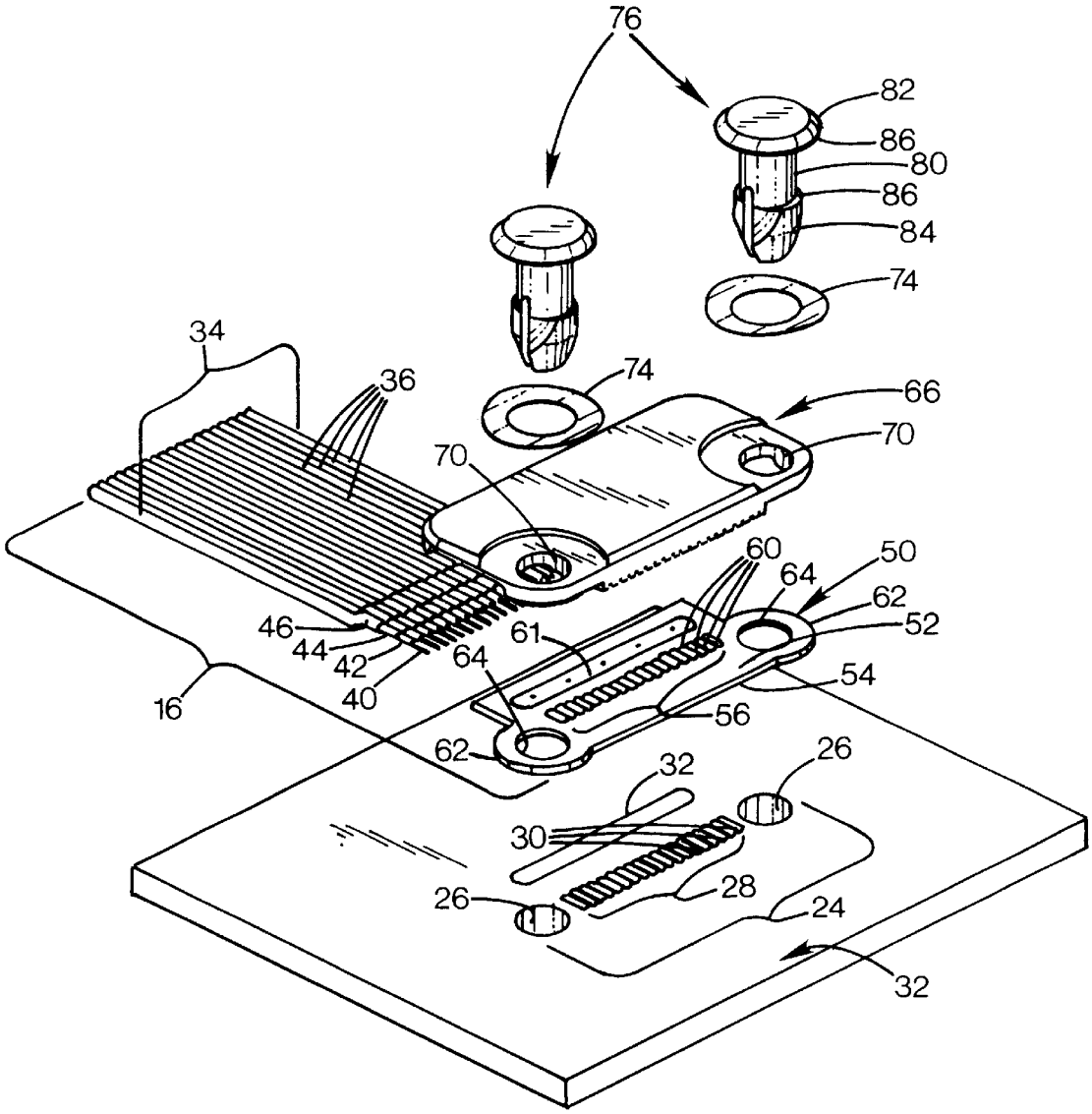
FIG. 2 is an exploded view of a cable assembly terminal according to the embodiment of FIG. 1.

FIG. 2 shows an exploded view of a connection between one end of the cable assembly 16 and one of the device board 22. The board has an interface region 24 having a pair of spaced-apart through holes 26 Between the holes is an array 28 of contacts 30. Each contact is electrically independent of the others, and connected by traces (not shown) to other circuitry on the board 22. The array of contacts is aligned on an axis in line with the holes 26, and the contacts are arranged evenly along this line. Each contact is an elongated bar oriented perpendicular to the line of the array, and parallel to the other contacts. In the preferred embodiment, there are 20 contacts, although this number can vary widely depending on the need, and is based on the number of wires in the cable, as will be discussed below. In the preferred embodiment, the contacts are plated with gold or another corrosion resistant metal to provide a low resistance contact over an extended device life. The contacts are preferably spaced apart with a center-to-center spacing of 0.025 inch, although this may range between 0.015 and 0.100 inch, depending on the need. A second board contact 32 is positioned near to the contact array 28. The second contact is an elongated bar as long as the contact array 28, and parallel to the array. The contact 32 is also connected to other board circuitry (not shown.)

The cable assembly includes a bundle 34 of fine coaxial wires 36 arranged side-by-side in ribbon form. Each of the wires includes a central conductor 40, which is sheathed with a dielectric layer 42. The dielectric layer is encompassed by a shield layer 44, which is encompassed by an outer jacket 46 of insulating material. In the preferred embodiment, the jackets are formed as one unit, so that the adjacent wires are joined together along their entire length. In an alternative embodiment, the wires may be joined in ribbon form at their ends, but loose in the middle portion, so that they may be received in an additional outer sheath to provide a round cable exterior. Before assembly, a segment of cable is stripped to the illustrated configuration, in which a portion of each central conductor extends beyond the sheath. Although the shield layer is shown as terminating before the end of the sheath for illustrative purposes, it preferably extends to the ends of the sheath. The jacket is stripped back far enough to expose a portion of the shield on each wire. Each end of the bundle is similarly stripped for embodiments requiring such connection at each end, although alternative embodiments may have only one end so stripped, with the other connected by conventional means.

In the preferred embodiment, the central conductor is a copper wire with a single strand of 38 wire gauge, although this may range between 44 and 36, depending on the need. The dielectric layer is formed of FEP, and has a wall thickness of 0.0045 inch, for an outside diameter of 0.013 inch, although this may range between 0.0065 and 0.065 inch, depending on the need. The shield is formed by a wrapping of 17 strands of 44 gauge copper wire. The jacket is formed of PVC, and provides an overall ribbon thickness of about 0.025 inch, although this may range between 0.015 and 0.100 inch, depending on the need. The center-to-center spacing of the wires is 0.025 inch in the preferred embodiment, although this may range between 0.015 and 0.100 inch, depending on the need.

The cable assembly includes a terminal sheet 50 at one or both ends. The sheet is a planar element formed of FR4, with a thickness of 0.060. It is essentially rigid, although some flexibility is tolerable in alternative embodiments. The sheet has an oblong shape, and is oriented perpendiculary to the axis of the cable bundle to which it is attached. The sheet 50 has a top surface 52 and a bottom surface 54. On the top surface, an array 56 of conductive top contacts 60 is oriented along the major axis of the sheet, spaced apart from each other with a spacing corresponding to the spacing of the central conductors of the wires of the cable ribbon. A second top contact 61 extends the length of the array, spaced apart therefrom and parallel thereto. The bottom surface of the sheet includes a pattern of contacts that is a mirror image of those on the board, so that they may overlay those of the board's interface region, providing one-to-one contact between each of the contacts only with the corresponding contact on the other component. As will be discussed below, there are conductive vias between each of the top contacts and each corresponding bottom contact. The termination sheet includes a pair of extending ears 62 that each define an aperture 64 that is sized and positioned the same as the corresponding apertures 26 on the board 22.

A clamp or lid member 66 is sized to overlay the entire sheet, and defines a pair of similar apertures 70 to register with those of the sheet and board. The lower surface of the lid is contoured to receive the wires ends and the terminal sheet, and the upper surface defines a concentric recess 72 about each aperture 70 to receive a spring washer 74. In the preferred embodiment, the lid is formed of a rigid thermoplastic material with electrically insulating properties. A pair of pins 76 have shanks 80 sized to fit closely within the apertures of the lid, sheet and board. A pin head 82 and a split tapered nose 84 each have opposed shoulder surfaces 86 that are spaced apart a selected distance to provide compression of the washer when installed.

Figure 3:
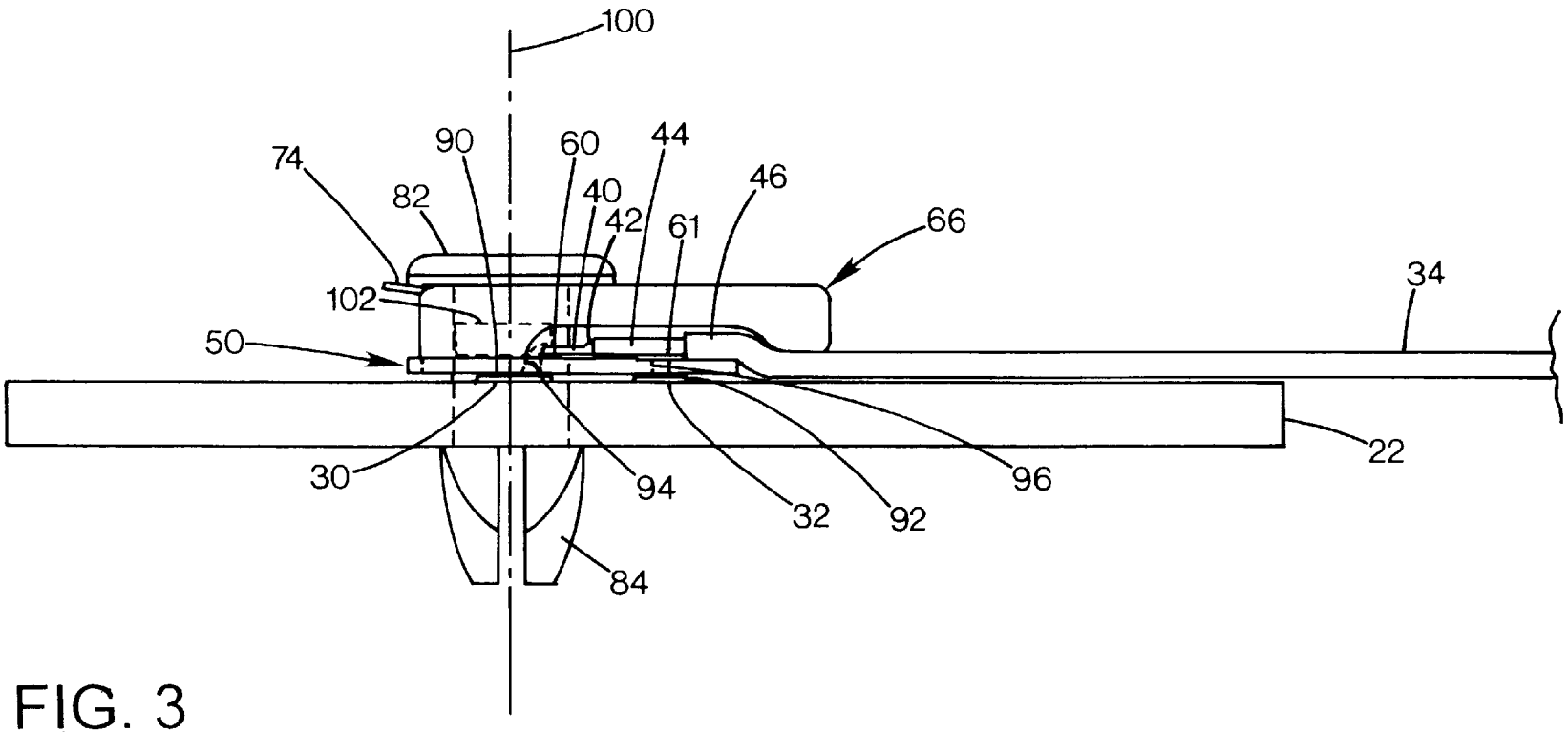
FIG. 3 is an enlarged section view of the terminal according to the embodiment of FIG. 1.

FIG. 3 shows the assembled and connected cable terminal. The cable assembly is assembled by positioning the ribbon end in alignment with the terminal sheet so that the central conductors each rest atop one corresponding contact 60, so that the shields 44 all rest atop the contact 61, and so that the shields do not contact any of the contacts 60. The wires are then soldered in the position by a reflow process. With one or both ends thus soldered, the cable assembly is completed, and may be stored, inventoried, and later installed, or shipped elsewhere for installation by another party.

As shown in FIG. 3, the terminal element 50 includes the above-described arrays of contacts on both sides. The lower side includes an array of lower contacts 90 that are located and shaped to overlay the contacts 30 of the board. A second lower contact 92 overlays contact 32 on the board. To provide communication between the contacts on each side of the sheet 50, a via 94 is defined in the sheet and plated through to connect each top contact 60 with the corresponding bottom contact 90. Similarly, several vias 96 are plated through to provide connection between contacts 61 and 92.

As installed, the sheet's lower contacts 90 are pressed against the board contacts 30 by the force of the captured spring washer 74. Nominally, the washers each provide a spring force distributed over the contact area to provide a pressure adequate to ensure ohmic contact for every contact. The axis 100 of the pins is aligned with the centers of the contacts 30, 90, to provide evenly distributed force. In alternative embodiments, a compressible elastomeric member 102 may be provided between the lid and the cable terminal sheet to provide the ongoing spring force, instead of or in addition to the spring washers.

In the preferred embodiment, the finely spaced contacts are arranged using "Gold Dot" patterns for standardization and convenience. However, any other standard or custom pattern of conductive contacts may be employed.

While the above is discussed in terms of preferred and alternative embodiments, the invention is not intended to be so limited. For instance, the wires may be more closely spaced than is practical to space the board contacts (such as where board precision is limited.) Such an embodiment may use more than one board contact array, so that the spacing of each array is wider, yet an adequate number of contacts are provided. Alternatively, the termination sheet may use extended traces to connect the top side contacts to the bottom side contacts, to enable the bottom side contacts to be more widely spread than the top side contacts.

What is claimed is:

1. A cable assembly comprising:

a plurality of wire elements;

each of the wire elements having a signal conductor encompassed by a dielectric sheath, and the sheath encompassed by a conductive shield;

the wire elements each having a first end, the first ends being arranged side-by-side in a row;

a terminal element connected to the wire elements;

the terminal element having a top surface and a bottom surface, an array of first contacts on the top surface, and an array of second contacts on the bottom surface, each of the first contacts being electrically connected to a corresponding one of the second contacts;

each of the signal conductors of the wire elements being ohmically connected to a corresponding one of the first contacts; and wherein the terminal element has a third contact connected to the shield of each of the wire elements.

2. The cable assembly of claim 1 wherein the wire elements are arranged in a flat ribbon.

3. The cable assembly of claim 1 including a corresponding second terminal element at an opposed end of the wire elements.

4. The cable assembly of claim 1 wherein the terminal element defines a registration element.

5. The cable assembly of claim 4 wherein the registration element includes at least a pair of holes.

6. The cable assembly of claim 1 wherein the terminal element is a planar member.

7. The cable assembly of claim 1 wherein the terminal element is a flexible sheet.

8. An electronic wiring assembly comprising:

a printed wiring element;

a cable assembly having opposed ends, one end connected to the printed wiring element;

the cable assembly comprising a plurality of wires each having a signal conductor and a surrounding shield;

the cable assembly having a terminal element at at least one end and connected to each of the wires;

the terminal element having opposed major faces, and having an array of first contacts on a first face to which the signal conductors of the wires are respectively connected, and an array of second contacts on the opposed face, each of the first contact being electrically connected to a corresponding second contact;

each of the second contacts overlaying and compressively contacting a corresponding contact in an array of conductive contacts on the printed wiring element; and a clamp connected to the printed wiring element with the terminal element captured therebetween.

9. The electronic wiring assembly of claim 8 wherein the printed wiring element is a circuit board.

10. The electronic wiring assembly of claim 8 wherein the printed wiring element is a first printed wiring element connected to a first end of the cable assembly, and including a second printed wiring element connected to a second end of the cable assembly.

11. The electronic wiring assembly of claim 8 wherein the clamp comprises a compression member biasing the terminal element against the printed wiring element.

12. The electronic wiring assembly of claim 8 wherein the printed wiring element defines a first set of apertures, and the terminal element defines a corresponding second set of apertures aligned with the first set.

13. The electronic wiring assembly of claim 12 including a plurality of pins, each of the pins closely received in each of the first apertures, each of the pins closely received in a second aperture.

14. The electronic wiring assembly of claim 13 wherein each pin is a fastener compressively retaining the terminal element against the printed wiring element.

15. The electronic wiring assembly of claim 8 wherein the first contacts are arrayed in a straight line, and wherein the wires arc closely arrayed in a ribbon at the at least one end of the cable assembly.

16. The electronic wiring assembly of claim 8 wherein the terminal element is a flexible sheet.

17. An electronic wiring assembly comprising:

a pair of circuit boards;

a cable assembly having opposed ends, each end connected to a respective one of the circuit boards;

the cable assembly comprising a plurality of coaxial wires each having a central conductor and a surrounding shield;

the cable assembly having a terminal element at each end and connected to each of the wires;

each terminal element being a flexible sheet having opposed major faces, and having an array of first contacts on a first face to which the central conductors of the wires are respectively connected, and an array of second contacts on the opposed face, each of the first contact being electrically connected to a corresponding second contact;

each of the second contacts overlaying and compressively contacting a corresponding contact in an array of conductive contacts on the corresponding circuit board; and a clamp connected to one of the circuit boards with one of the terminal elements captured therebetween, and an elastic compression member compressively received between the clamp and the termination element to bias the second contacts against the conductive contacts of the one of the circuit boards.

18. The electronic wiring assembly of claim 17 wherein the terminal element includes an elongated contact on the first face, and wherein the surrounding shield of each wire is connected to the elongated contact.

19. An electronic wiring assembly comprising:

a printed wiring element;

a cable assembly having opposed ends, one end connected to the printed wiring element;

the cable assembly comprising a plurality of wires each having a signal conductor and a surrounding shield;

the cable assembly having a terminal element at at least one end and connected to each of the wires;

the terminal element having opposed major faces, and having an array of first contacts on a first face to which the signal conductors of the wires are respectively connected, and an array of second contacts on the opposed face, each of the first contact being electrically connected to a corresponding second contact;

each of the second contacts overlaying and compressively contacting a corresponding contact in an array of conductive contacts on the printed wiring element;

the printed wiring element defining a first set of apertures, and the terminal element defining a corresponding second set of apertures aligned with the first set; and a plurality of pins, each of the pins closely received in each of the first apertures, each of the pins closely received in a second aperture.

20. The electronic wiring assembly of claim 19 wherein each pin is a fastener compressively retaining the terminal element against the printed wiring element.

21. The cable assembly of claim 1 wherein each wire element is a coaxial wire.

22. The electronic wiring assembly of claim 8 wherein each wire is a coaxial wire.

23. The electronic wiring assembly of claim 8 wherein the terminal element has a third contact connected to the shield of each of the wire elements.

* * * * *